US009972881B2

(12) United States Patent
Tang et al.

(10) Patent No.: US 9,972,881 B2
(45) Date of Patent: May 15, 2018

(54) COAXIAL LINE-TO-WAVEGUIDE ADAPTER COMPRISING A LEFT-HANDED MATERIAL USED AS AN ELECTROMAGNETIC PARAMETER ADJUSTING COMPONENT

(71) Applicant: Huawei Technologies Co., Ltd., Shenzhen, Guangdong (CN)

(72) Inventors: Fusheng Tang, Segrate (IT); Yanxing Luo, Chengdu (CN); Zhuo Zeng, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 54 days.

(21) Appl. No.: 15/051,404

(22) Filed: Feb. 23, 2016

(65) Prior Publication Data

US 2016/0172735 A1 Jun. 16, 2016

Related U.S. Application Data

(63) Continuation of application No. PCT/CN2013/082144, filed on Aug. 23, 2013.

(51) Int. Cl.

| | |
|---|---|
| ***H01P 5/103*** | (2006.01) |
| ***H01P 5/08*** | (2006.01) |
| ***H01P 11/00*** | (2006.01) |

(52) U.S. Cl.

CPC ..... *H01P 5/103* (2013.01); *H01P 5/08* (2013.01); *H01P 11/001* (2013.01)

(58) Field of Classification Search

CPC ..... H01P 5/103; H01P 5/107

(Continued)

(56) References Cited

U.S. PATENT DOCUMENTS 2,527,146 A * 10/1950 Mumford ..... H01P 5/103 333/254
4,533,884 A * 8/1985 Hudspeth et al. ..... H01P 5/103 333/21 R (Continued)

FOREIGN PATENT DOCUMENTS

CN 201163656 Y 12/2008
CN 101414699 A 4/2009

(Continued)

OTHER PUBLICATIONS

Silvio Hrabar, "Miniaturized Open-Ended Radiator Based on Waveguide Filled with Uniaxial Negative Permeability Metamaterial", IEEE, 2005, p. 667-670.

(Continued)

*Primary Examiner* — Benny Lee

(57) ABSTRACT

The present invention provides a coax-waveguide adapter, which improves in-band flatness of a reflection coefficient in a simple way. The coax-waveguide adapter includes: a cavity-shaped waveguide connection component, a coaxial external conductor connected to the cavity-shaped waveguide connection component, and a coaxial internal conductor that is disposed inside the coaxial external conductor along an axial direction of the coaxial external conductor and inserted into the cavity-shaped waveguide connection component, where the coax-waveguide adapter further includes: an electromagnetic parameter adjusting component that is disposed inside a cavity of the cavity-shaped waveguide connection component and used for reducing an effective dielectric constant and an effective magnetic conductivity of the coax-waveguide adapter. According to the coax-waveguide adapter provided in the present invention, an external geometrical shape and geometrical dimension of (Continued)

the coax-waveguide adapter are not changed, an implementation manner is simple and easy, costs are low.

10 Claims, 4 Drawing Sheets

(58) Field of Classification Search
USPC ..... 333/26
See application file for complete search history.

(56) References Cited

U.S. PATENT DOCUMENTS

| | | | | |
|---|---|---|---|---|
| 5,708,401 | A * | 1/1998 | Umezu | H01P 5/103 333/26 |
| 2002/0097111 | A1 | 7/2002 | Holden et al. | |

FOREIGN PATENT DOCUMENTS

| | | | |
|---|---|---|---|
| CN | 202384474 | U | 8/2012 |
| CN | 103013440 | A | 4/2013 |
| CN | 203013908 | U | 6/2013 |
| EP | 1 432 062 | A1 | 6/2004 |
| EP | 1 720 213 | A1 | 11/2006 |
| JP | 2002-217617 | A | 8/2002 |
| JP | 2005-109933 | A | 4/2005 |

OTHER PUBLICATIONS

Chuan Ding et al., "The design of coaxial-to-rectangular waveguide transitions adapter with SMA connector at high frequency", Dec. 31, 2009, p. 446-448.

* cited by examiner

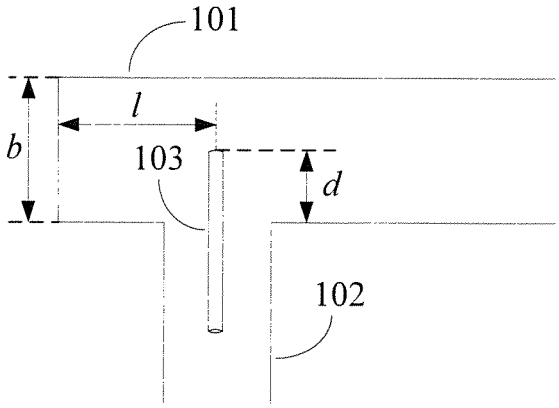
FIG. 1-a (Prior Art)
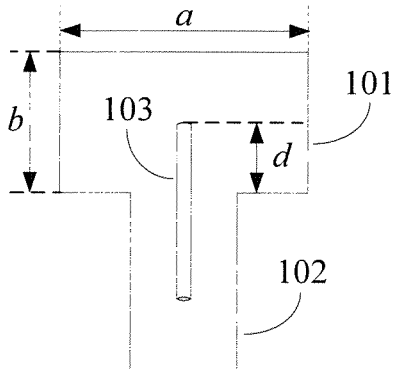
FIG. 1-b (Prior Art)
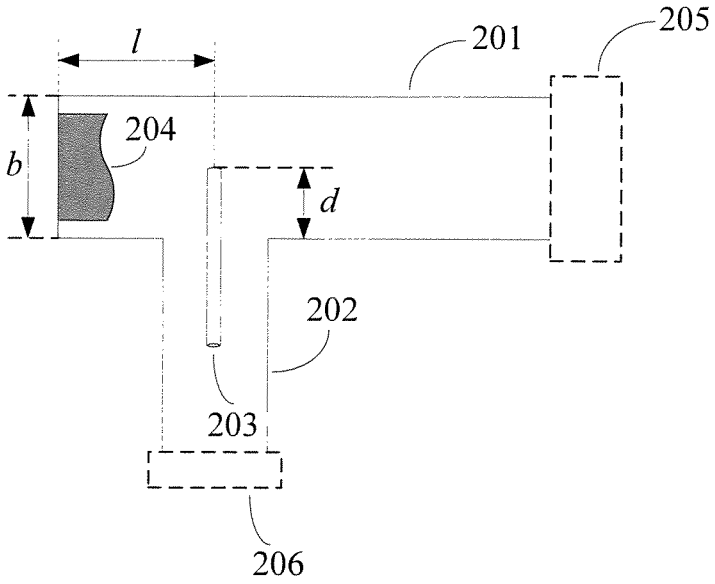
FIG. 2-a

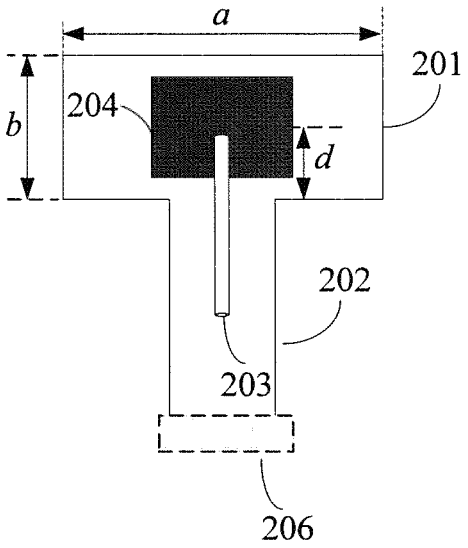
FIG. 2-b
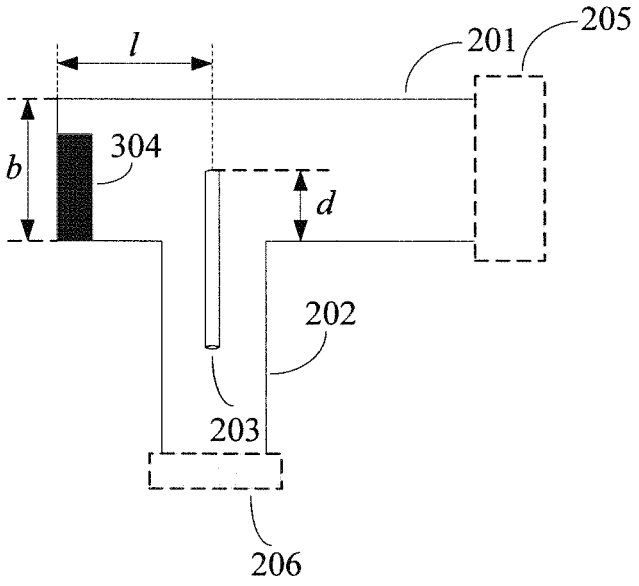
FIG. 3-a

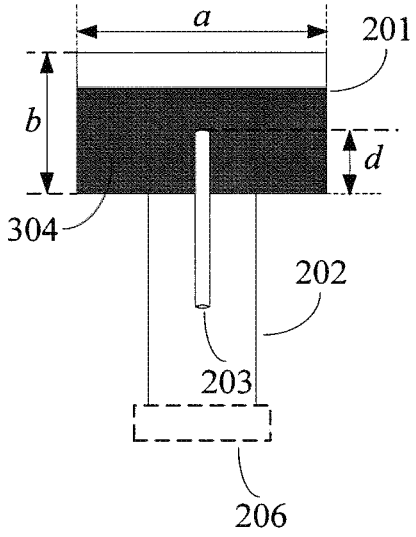
FIG. 3-b
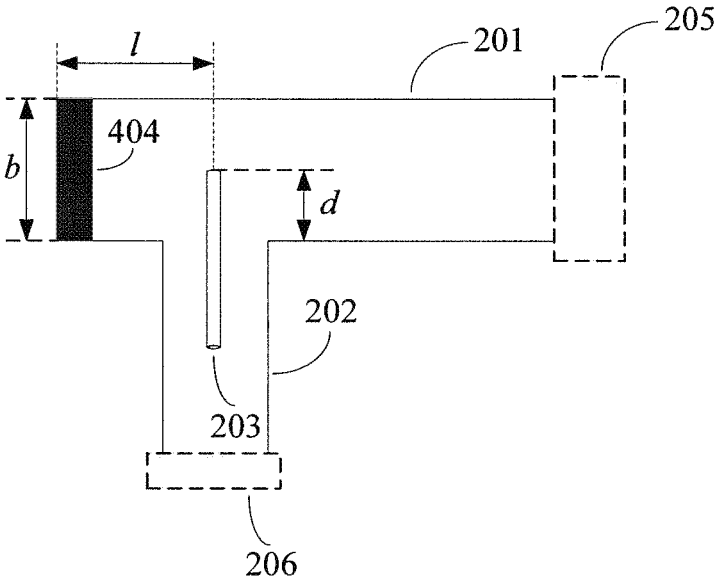
FIG. 4-a

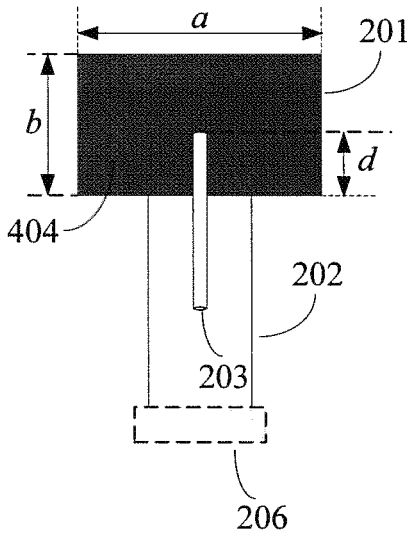
FIG. 4-b

COAXIAL LINE-TO-WAVEGUIDE ADAPTER COMPRISING A LEFT-HANDED MATERIAL USED AS AN ELECTROMAGNETIC PARAMETER ADJUSTING COMPONENT

CROSS-REFERENCE TO RELATED APPLICATIONS

This application is a continuation of International Application No. PCT/CN2013/082144, filed on Aug. 23, 2013, which is hereby incorporated by reference in its entirety.

TECHNICAL FIELD

The present invention relates to the communications field, and in particular, to a coaxial line-to-waveguide adapter.

BACKGROUND

A coaxial line-to-waveguide adapter (CWA) is a device, in an antenna feed structure, used for connecting a waveguide and a coaxial cable. An orthogonal coaxial line-to-waveguide adapter becomes a most commonly used type of coaxial line-to-waveguide adapter because of a simple design of the orthogonal coaxial line-to-waveguide adapter. As shown in FIG. 1-*a*, FIG. 1-*a* is a front view of an existing orthogonal coaxial line-to-waveguide adapter, and FIG. 1-*b* is a left view, corresponding to FIG. 1-*a*, of an orthogonal coaxial line-to-waveguide adapter. A horizontal section of FIG. 1-*a* or FIG. 1-*b* is a waveguide connection component 101 of the coaxial line-to-waveguide adapter, and a vertical section thereof is a coaxial external conductor 102. The waveguide connection component 101 is essentially a waveguide. When the orthogonal coaxial line-to-waveguide adapter is used, the waveguide connection component 101 is connected to a waveguide, and one end of the coaxial external conductor 102 is connected to a coaxial cable. In FIG. 1-*a* and FIG. 1-*b*, a dimension of a wide side of the waveguide connection component 101 is a (FIG. 1-*a*), and a dimension of a narrow side of the waveguide connection component 101 is b. A coaxial internal conductor 103 of the orthogonal coaxial line-to-waveguide adapter is generally inserted, at the center of a wide side of the waveguide connection component 101, into the wide side of the waveguide connection component 101 in a form of a probe. The other end of the coaxial external conductor 102 is connected to a wall of the waveguide connection component 101 (by means of, for example, welding or connecting by using a screw). Impedance matching can be implemented theoretically by adjusting a depth d at which the coaxial internal conductor 103 is inserted into the waveguide connection component 101 and a distance 1 (FIG. 1-*a*) between the coaxial internal conductor 103 and a waveguide short-circuit end of the waveguide connection component 101. However, the foregoing method for implementing impedance matching can well implement impedance matching only at one frequency (a center frequency of a frequency band is usually selected), but generally, operating bandwidth of a system is relatively large, and therefore when considered bandwidth is relatively large, flatness of a reflection coefficient in an entire frequency band is still relatively poor, and for some systems that have a high requirement on in-band flatness, such unsatisfactory flatness of a reflection coefficient brings serious impact.

For the foregoing technical problem, a solution provided in the prior art is designing a coaxial line-to-waveguide adapter for varied frequency bands, and another solution is adding an impedance matcher on the basis of an existing coaxial line-to-waveguide adapter. For the solution of designing a coaxial line-to-waveguide adapter for varied frequency bands, costs of the solution are high, and for a bandwidth system, multiple devices are needed to implement one system, thereby causing more inconvenience. For the solution of adding an impedance matcher, design of the solution is complex, and system matching is difficult to implement within a relatively wide frequency band.

SUMMARY

Technical Problem

Embodiments of the present invention provide a coaxial line-to-waveguide adapter, so as to improve in-band flatness of a reflection coefficient in a simple way.

Technical Solutions

According to a first aspect, a coaxial line-to-waveguide adapter is provided, including: a cavity-shaped waveguide connection component, a coaxial external conductor connected to the cavity-shaped waveguide connection component, and a coaxial internal conductor that is disposed inside the coaxial external conductor along an axial direction of the coaxial external conductor and inserted into the cavity-shaped waveguide connection component, where the coaxial line-to-waveguide adapter further includes: an electromagnetic parameter adjusting component that is disposed inside a cavity of the cavity-shaped waveguide connection component and used for reducing an effective dielectric constant and an effective magnetic conductivity of the coaxial line-to-waveguide adapter.

With reference to the first aspect, in a first possible implementation manner of the first aspect, the electromagnetic parameter adjusting component is made of a left-handed material.

With reference to the first possible implementation manner of the first aspect, in a second possible implementation manner of the first aspect, one side of a waveguide short-circuit end of the cavity-shaped waveguide connection component is filled, along an axial direction of the cavity-shaped waveguide connection component, with the electromagnetic parameter adjusting component made of the left-handed material, and each side surface of the electromagnetic parameter adjusting component is seamlessly spliced with each inner wall of the cavity-shaped waveguide connection component.

With reference to the first possible implementation manner of the first aspect, in a third possible implementation manner of the first aspect, one side of a waveguide short-circuit end of the cavity-shaped waveguide connection component is filled, along an axial direction of the cavity-shaped waveguide connection component, with the electromagnetic parameter adjusting component made of the left-handed material, and at least one side surface of the electromagnetic parameter adjusting component is not seamlessly spliced with one inner wall of the cavity-shaped waveguide connection component.

With reference to the first, the second or the third possible implementation manner of the first aspect, in a fourth possible implementation manner of the first aspect, along the axial direction of the cavity-shaped waveguide connection component, a dimension of the electromagnetic parameter adjusting component is not greater than a distance between the coaxial internal conductor and the short-circuit end of the cavity-shaped waveguide connection component.

With reference to the first, the second, or the third possible implementation manner of the first aspect, in a fifth possible implementation manner of the first aspect, a depth at which the coaxial internal conductor is inserted into the cavity-shaped waveguide connection component is d, a distance between the coaxial internal conductor and the waveguide short-circuit end of the cavity-shaped waveguide connection component is l, a dimension of the electromagnetic parameter adjusting component along the axial direction of the cavity-shaped waveguide connection component is h, and adjustment of a value of d, l, and/or h is used for limiting a range of a quantity of effective waves of the coaxial line-to-waveguide adapter.

According to a second aspect, a method for making a coaxial line-to-waveguide adapter is provided, including: making a cavity-shaped waveguide connection component that can fit a waveguide that needs to be connected, connecting a coaxial external conductor and the cavity-shaped waveguide connection component, disposing a coaxial internal conductor inside the coaxial external conductor along an axial direction of the coaxial external conductor, and inserting the coaxial internal conductor into the cavity-shaped waveguide connection component, where the method further includes:

disposing an electromagnetic parameter adjusting component inside a cavity of the cavity-shaped waveguide connection component, where the electromagnetic parameter adjusting component is used for adjusting an effective dielectric constant and an effective magnetic conductivity of the coaxial line-to-waveguide adapter.

With reference to the second aspect, in a first possible implementation manner of the second aspect, the electromagnetic parameter adjusting component is made of a left-handed material.

With reference to the first possible implementation manner of the second aspect, in a second possible implementation manner of the second aspect, the disposing an electromagnetic parameter adjusting component inside a cavity of the cavity-shaped waveguide connection component includes:

filling, along an axial direction of the cavity-shaped waveguide connection component, one side of a waveguide short-circuit end of the cavity-shaped waveguide connection component with the electromagnetic parameter adjusting component made of the left-handed material, and enabling each side surface of the electromagnetic parameter adjusting component to be seamlessly spliced with each inner wall of the cavity-shaped waveguide connection component.

With reference to the first possible implementation manner of the second aspect, in a third possible implementation manner of the second aspect, the disposing an electromagnetic parameter adjusting component inside a cavity of the cavity-shaped waveguide connection component includes:

filling, along an axial direction of the cavity-shaped waveguide connection component, one side of a waveguide short-circuit end of the cavity-shaped waveguide connection component with the electromagnetic parameter adjusting component made of the left-handed material, and enabling at least one side surface of the electromagnetic parameter adjusting component not to be seamlessly spliced with one inner wall of the cavity-shaped waveguide connection component.

With reference to the first, the second or the third possible implementation manner of the second aspect, in a fourth possible implementation manner of the second aspect, along the axial direction of the cavity-shaped waveguide connection component, a dimension of the electromagnetic parameter adjusting component is not greater than a distance between the coaxial internal conductor and the short-circuit end of the cavity-shaped waveguide connection component.

With reference to the first, the second, or the third possible implementation manner of the second aspect, in a fifth possible implementation manner of the second aspect, the method further includes: limiting a range of a quantity of effective waves of the coaxial line-to-waveguide adapter by adjusting a value of d, l, and/or h, where d is a depth at which the coaxial internal conductor is inserted into the cavity-shaped waveguide connection component, l is a distance between the coaxial internal conductor and the waveguide short-circuit end of the cavity-shaped waveguide connection component, and h is a dimension of the electromagnetic parameter adjusting component along the axial direction of the cavity-shaped waveguide connection component.

Beneficial Effects

In the coaxial line-to-waveguide adapter provided in the embodiments of the present invention, because an electromagnetic parameter adjusting component that is used for reducing an effective dielectric constant and an effective magnetic conductivity of the coaxial line-to-waveguide adapter is disposed inside a cavity of a cavity-shaped waveguide connection component, an external geometrical shape and geometrical dimension of the coaxial line-to-waveguide adapter are not changed. Therefore, compared with the existing solutions that improve in-band flatness of a reflection coefficient by designing a coaxial line-to-waveguide adapter for varied frequency bands or adding an impedance matcher on the basis of an existing coaxial line-to-waveguide adapter, the coaxial line-to-waveguide adapter provided in the embodiments of the present invention has a simple and easy implementation manner and low costs, but can effectively improve in-band flatness of a reflection coefficient.

BRIEF DESCRIPTION OF THE DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

FIG. 1-*a* is a front view of an orthogonal coaxial line-to waveguide adapter in the prior art;

FIG. 1-*b* is a left view corresponding to the front view of the orthogonal coaxial line-to waveguide adapter shown in FIG. 1-*a;*

FIG. 2-*a* is a front view of a coaxial line-to waveguide adapter according to an embodiment of the present invention;

FIG. 2-*b* is a left view corresponding to the front view of the coaxial line-to waveguide adapter in FIG. 2-*a* according to an embodiment of the present invention;

FIG. 3-*a* is a front view of a coaxial line-to waveguide adapter according to another embodiment of the present invention;

FIG. 3-*b* is a left view corresponding to the front view of the coaxial line-to waveguide adapter in FIG. 3-*a* according to an embodiment of the present invention;

FIG. 4-*a* is a front view of a coaxial line-to adapter according to another embodiment of the present invention; and FIG. 4-*b* is a left view corresponding to the front view of the coaxial line-to waveguide adapter in FIG. 4-*a* according to an embodiment of the present invention.

DETAILED DESCRIPTION

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Referring to FIG. 2-*a* and FIG. 2-*b*, FIG. 2-*a* is a front view of a coaxial line-to waveguide adapter according to an embodiment of the present invention, and FIG. 2-*b* is a left view corresponding to the front view shown in FIG. 2-*a*. The coaxial line-to waveguide adapter shown in FIG. 2-*a* or FIG. 2-*b* (a part represented by a solid line in those figures) includes a cavity-shaped waveguide connection component 201, a coaxial external conductor 202 connected to the cavity-shaped waveguide connection component 201, and a coaxial internal conductor 203 that is disposed inside the coaxial external conductor 202 along an axial direction of the coaxial external conductor 202 and inserted into the cavity-shaped waveguide connection component 201. For the coaxial line-to waveguide adapter shown in FIG. 2-*a*, a left end of the cavity-shaped waveguide connection component 201 is a short-circuit end that is made of a conductive material, and the left end of the cavity-shaped waveguide connection component 201 is closed to form a bottom of a cavity; and a right end of the cavity-shaped waveguide connection component 201 is an opening of the cavity. When the coaxial line-to waveguide adapter is used, the right end of the cavity-shaped waveguide connection component 201 is connected to a waveguide 205 (FIG. 2-*a*), and an end, which is not connected to the cavity-shaped waveguide connection component 201, of the coaxial external conductor 202 is connected to a coaxial cable 206. There is a non-conductive filling substance (not shown) between the coaxial external conductor 202 and the coaxial internal conductor 203, so that the coaxial internal conductor 203 can be fixed in the coaxial external conductor 202. A difference from the prior art lies in that, the coaxial line-to waveguide adapter shown in FIG. 2-*a* or FIG. 2-*b* further includes an electromagnetic parameter adjusting component 204 that is disposed inside the cavity of the cavity-shaped waveguide connection component 201 and used for reducing an effective dielectric constant and an effective magnetic conductivity of the coaxial line-to waveguide adapter. In-band flatness of a reflection coefficient is related to the effective dielectric constant and the effective magnetic conductivity of the coaxial line-to waveguide adapter, and therefore, the in-band flatness of the reflection coefficient may be improved by adjusting the effective dielectric constant and the effective magnetic conductivity of the coaxial line-to waveguide adapter. In FIG. 2-*a* and FIG. 2-*b*, a is a dimension of a wide side of the cavity-shaped waveguide connection component 201 as shown in FIG. 2-*b*, b is a dimension of a narrow side of the cavity-shaped waveguide connection component 201, d is a depth at which the coaxial internal conductor 203 is inserted into the cavity-shaped waveguide connection component 201 along the axial direction of the coaxial external conductor 202, and as shown in FIG. 2-*a*, l is a distance between the coaxial internal conductor 203 and the short-circuit end of the cavity-shaped waveguide connection component 201 along an axial direction of the cavity-shaped waveguide connection component 201.

For the coaxial line-to waveguide adapter shown in FIG. 2-*a* or FIG. 2-*b*, because an electromagnetic parameter adjusting component that is used for reducing an effective dielectric constant and an effective magnetic conductivity of the coaxial line-to waveguide adapter is disposed inside a cavity of a cavity-shaped waveguide connection component, an external geometrical shape and geometrical dimension of the coaxial line-to waveguide adapter are not changed, and therefore, compared with the existing solutions that improve in-band flatness of a reflection coefficient by designing a coaxial line-to waveguide adapter for varied frequency bands or adding an impedance matcher on the basis of an existing coaxial line-to waveguide adapter, the coaxial line-to waveguide adapter provided in this embodiment of the present invention has a simple and easy implementation manner and low costs, but can effectively improve in-band flatness of a reflection coefficient.

As an embodiment of the present invention, for the coaxial line-to waveguide adapter shown in FIG. 2-*a* or FIG. 2-*b*, the electromagnetic parameter adjusting component may be made of a left-handed material (LHM). The left-handed material (or referred to as "negative refractive index material"), relative to a medium that enables, in an electromagnetic wave propagation process, an electric field, a magnetic field, and an electromagnetic wave propagation constant to form a right-handed triplet relationship, specifically refers to a material that has a negative dielectric constant ($\in$) and a negative magnetic conductivity ($\mu$) (that is, $\in<0$ and $\mu<0$). In the medium of the left-handed material, an electric field, a magnetic field, and an electromagnetic wave propagation constant form a left-handed triplet relationship. The following describes reasons why when the electromagnetic parameter adjusting component 204 made of the left-handed material is disposed inside the cavity of the cavity-shaped waveguide connection component 201 shown in FIG. 2-*a* or FIG. 2-*b*, the electromagnetic parameter adjusting component 204 can adjust the effective dielectric constant and the effective magnetic conductivity of the coaxial line-to waveguide adapter, and further improve the in-band flatness of the reflection coefficient.

For a coaxial line-to waveguide adapter that is not provided with a left-handed material, an input impedance $Z_{in}$ expression of the coaxial line-to waveguide adapter is as follows:

$$Z_{in} = \frac{G_{11}G_{22} - G_{12}^2}{e_1G_{22} + e_2G_{11} - (e_1 + e_2)G_{12}} \tag{1}$$

where $$G_{11} = g_0P_0^2 + \sum_{m=1}^{+\infty} g_mP_m^2 \tag{2}$$

$$G_{12} = g_0P_0Q_0 + \sum_{m=1}^{+\infty} g_mP_mQ_m \tag{3}$$

$$G_{22} = g_0Q_0^2 + \sum_{m=1}^{+\infty} g_mQ_m^2 \tag{4}$$

-continued $$P_m = \left[k\left(\cos kd - \cos\frac{m\pi d}{b}\right)\right] \Big/ \left\{\left[\left(\frac{m\pi}{b}\right)^2 - k^2\right]\sin kd\right\} \quad (5)$$

$$Q_m = [k\sin kd - (k^2 b/m\pi)\sin(m\pi d/b)] \Big/ \left\{\left[\left(\frac{m\pi}{b}\right)^2 - k^2\right](1-\cos kd)\right\}; \quad (6)$$

$e_1$ and $e_2$ are constants determined by two integrals that are related to a wave mode and a frequency; $G_{11}$ is the correlation coefficient of the first basis function itself weighted by dyadic Green's function; $G_{12}$ is the correlation coefficient of the first and second basis function weighted by dyadic Green's function; $G_{22}$ is the correlation coefficient of the second basis function itself weighted by dyadic Green's function; $g_0$ and $g_m$ are coefficients related to a mode $P_0$ and $P_m$ are expansion coefficients of a first basis function by cosine series; $Q_0$ and $Q_m$ are expansion coefficients of a second basis function by cosine series: and m is the number of terms.

For the coaxial line-to waveguide adapter that is not provided with a left-handed material, a cavity-shaped waveguide connection component of the coaxial line-to waveguide adapter is internally filled with air, and therefore, k in the expressions (5) and (6) is a wave number $k_0$ in free space.

After the coaxial line-to waveguide adapter is filled with the electromagnetic parameter adjusting component 204 made of the left-handed material, because the dielectric constant $\in$ and magnetic conductivity $\mu$ of the left-handed material are both negative, it is equivalent to the effective dielectric constant and magnetic conductivity of the coaxial line-to waveguide adapter being changed, that is, effective wave number $k_e$ of waves in the coaxial line-to waveguide adapter is changed, where $k_e$ is a function of free space wave number $k_0$, geometric parameters a, b, d, and l of the coaxial line-to waveguide adapter, wave number $k_1$ of the left-handed material, and h:

$$k_e = k_e(k_0, -k_1, a, b, d, l, h) \quad (7).$$

Assuming that electromagnetic parameters of the left-handed material are $(-\mu_1, -\in_1)$, it may be obtained, by using an effective dielectric constant method, that the effective wave number $k_e$ of the coaxial line-to waveguide adapter provided in this embodiment of the present invention approximately meets an expression as follows:

$$j\eta_0\sqrt{\frac{\mu_1}{\varepsilon_1}}\,tg\left(-h\sqrt{k_e^2 - \left[k_0^2 - \left(\frac{\pi}{a}\right)^2\right]}\right) - \eta_0 ctg\left[\sqrt{k_e^2 - \left[k_0^2 - \left(\frac{\pi}{a}\right)^2\right]}\,\frac{2\lambda_0}{\sqrt{1-\left(\frac{\lambda_0}{2a}\right)^2}}\right] = 0. \quad (8)$$

where j is an imaginary unit, and $-\mu_1$ is the magnetic conductivity of the left-handed material.

In the foregoing expression (7) and/or (8), a is a dimension of a wide side of the cavity-shaped waveguide connection component 201, b is a dimension of a narrow side of the cavity-shaped waveguide connection component 201, d is a depth at which the coaxial internal conductor 203 is inserted into the cavity-shaped waveguide connection component 201 along the axial direction of the coaxial external conductor 202, l is a distance between the coaxial internal conductor 203 and the short-circuit end of the cavity-shaped waveguide connection component 201 along an axial direction of the cavity-shaped waveguide connection component 201, h is a dimension of the electromagnetic parameter adjusting component 204 along the axial direction of the cavity-shaped waveguide connection component 201, $\eta_0$ is free space wave impedance, and $\lambda_0$ is a free space wave length, where a function of d, l, and/or h lies in that: by adjusting a value of d, l, and/or h, the effective wave number $k_e$ of the coaxial line-to waveguide adapter may be limited to falling within a certain range, for example, making the effective wave number $k_e$ become smaller.

The effective wave number $k_e$, the effective dielectric constant $\in_{re}$, the effective magnetic conductivity $\mu_{re}$ and the free space wave number $k_0$ have the following relationship: $k_e = k_0\sqrt{\in_{re}}\sqrt{\mu_{re}}$, and a value range of the free space wave number $k_0$ does not change when a frequency range does not change, and therefore, when an effective range of the effective wave number $k_e$ is made narrower by equivalently reducing the effective dielectric constant £$_{re}$ and the effective magnetic conductivity $\mu_{re}$ of an orthogonal coaxial line-to waveguide adapter, and operating frequency is proportional to $k_e$, so the operating frequency is made lower, it is equivalent to operating bandwidth being compressed, so that the in-band flatness of the reflection coefficient is improved, that is, the reflection coefficient becomes flatter. For a transcendental equation of the expression (8), an explicit solution of $k_e$ does not need to be searched for. In fact, because of negative propagation constants (the dielectric constant s and magnetic conductivity $\mu$ are both negative) brought about by the left-handed material, in this case, as long as the value of d, l, and/or h is adjusted properly, a value range of the effective wave number $k_e$ can be limited to an appropriate range narrower than that is used when the electromagnetic parameter adjusting component 204 made of the left-handed material is not disposed, so that the reflection coefficient in an operating band presents better flatness. A process for searching for the effective wave number $k_e$ may be completed by numerical calculation, for example, by programming calculation, and some parameter tables are provided later (similar to tables in a special function manual), so that an approximate relationship may be obtained by searching the tables.

As an embodiment of the present invention, one side of a waveguide short-circuit end of the cavity-shaped waveguide connection component 201 is filled, along the axial direction of the cavity-shaped waveguide connection component 201, with the electromagnetic parameter adjusting component 204 made of the left-handed material and shown in FIG. 2-*a* or FIG. 2-*b*. As shown in FIG. 3-*a* or FIG. 3-*b*, FIG. 3-*a* is a front view of a coaxial line-to waveguide adapter according to another embodiment of the present invention, and FIG. 3-*b* is a left view corresponding to the front view shown in FIG. 3-*a*. At least one side surface of an electromagnetic parameter adjusting component 304 made of a left-handed material and shown in FIG. 3-*a* or FIG. 3-*b* is not seamlessly spliced with one inner wall of a cavity-shaped waveguide connection component 201. For example, an interval or a gap exists between one side surface of the electromagnetic parameter adjusting component 304 made of the left-handed material and an upper inner wall of the cavity-shaped waveguide connection component 201. In this case, a transverse cross-section of the electromagnetic parameter adjusting component 304 is smaller than a transverse cross-section of a geometry that is surrounded by inner walls of the cavity-shaped waveguide connection component 201, which indicates that the electromagnetic parameter adjusting component 304 made of the left-handed material only fills partial space on the side of a short-circuit end of the cavity-shaped waveguide connection component 201. In FIG. 3-*a* and FIG. 3-*b*, a is a dimension of a wide side of the cavity-shaped waveguide connection component 201 as shown in FIG. 3-*b*, b is a dimension of a narrow side of the cavity-shaped waveguide connection component 201, d is a depth at which the coaxial internal conductor 203 is inserted into the cavity-shaped waveguide connection component 201 along the axial direction of the coaxial external conductor 202, and as shown in FIG. 3-*a*, l is a distance between the coaxial internal conductor 203 and the short-circuit end of the cavity-shaped waveguide connection component 201 along an axial direction of the cavity-shaped waveguide connection component 201. An end of the coaxial external conductor 202 is connected to the coaxial cable 206.

As another embodiment of the present invention, one side of a waveguide short-circuit end of the cavity-shaped waveguide connection component 201 is filled, along the axial direction of the cavity-shaped waveguide connection component 201, with the electromagnetic parameter adjusting component 204 made of the left-handed material and shown in FIG. 2-*a* or FIG. 2-*b*. As shown in FIG. 4-*a* or FIG. 4-*b*, FIG. 4-*a* is a front view of a coaxial line-to waveguide adapter according to another embodiment of the present invention, and FIG. 4-*b* is a left view corresponding to the front view shown in FIG. 4-*a*. Each side surface of an electromagnetic parameter adjusting component 404 made of a left-handed material and shown in FIG. 4-*a* or FIG. 4-*b* is seamlessly spliced with each inner wall of a cavity-shaped waveguide connection component 201, that is, a transverse cross-section of the electromagnetic parameter adjusting component 404 and a transverse cross-section of a geometry that is surrounded by inner walls of the cavity-shaped waveguide connection component 201 are of a same shape and a same size. Compared with the electromagnetic parameter adjusting component 304 shown in FIG. 3-*a* or FIG. 3-*b*, for the electromagnetic parameter adjusting component 404 shown in FIG. 4-*a* or FIG. 4-*b*, on one hand, it is easier to provide analytical analysis on the entire coaxial line-to waveguide adapter and an empirical table formed by an analysis result, to facilitate table searching performed when a coaxial line-to waveguide adapter of a same type is designed subsequently; and on the other hand, each side surface of the electromagnetic parameter adjusting component 404 is seamlessly spliced with each inner wall of the cavity-shaped waveguide connection component 201, the connection manner avoids boundary discontinuity introduced in multiple directions, and can reduce amplitude and a mode quantity of higher order modes, thereby reducing an insertion loss of the coaxial line-to waveguide adapter. In FIG. 4-*a* and FIG. 4-*b*, a is a dimension of a wide side of the cavity-shaped waveguide connection component 201 as shown in FIG. 4-*b*, b is a dimension of a narrow side of the cavity-shaped waveguide connection component 201, d is a depth at which the coaxial internal conductor 203 is inserted into the cavity-shaped waveguide connection component 201 along the axial direction of the coaxial external conductor 202, and as shown in FIG. 4-*b*, l is a distance between the coaxial internal conductor 203 and the short-circuit end of the cavity-shaped waveguide connection component 201 along an axial direction of the cavity-shaped waveguide connection component 201. An end of the coaxial external conductor 202 is connected to the coaxial cable 206.

In the coaxial line-to waveguide adapter provided in any embodiment of FIG. 2-*a*, FIG. 2-*b*, FIG. 3-*a*, FIG. 3-*b*, FIG. 4-*a* and FIG. 4-*b*, along the axial direction of the cavity-shaped waveguide connection component 201, a dimension of the electromagnetic parameter adjusting component is not greater than the distance between the coaxial internal conductor 203 and the short-circuit end of the cavity-shaped waveguide connection component 201.

An embodiment of the present invention further provides a method for making a coaxial line-to waveguide adapter, including: making a cavity-shaped waveguide connection component that can fit a waveguide that needs to be connected, connecting a coaxial external conductor and the cavity-shaped waveguide connection component, disposing a coaxial internal conductor inside the coaxial external conductor along an axial direction of the coaxial external conductor, and inserting the coaxial internal conductor into the cavity-shaped waveguide connection component. A difference from the prior art lies in that: the method for making a coaxial line-to waveguide adapter according to this embodiment of the present invention further includes: disposing an electromagnetic parameter adjusting component inside a cavity of the cavity-shaped waveguide connection component, where the electromagnetic parameter adjusting component is used for adjusting an effective dielectric constant and an effective magnetic conductivity of the coaxial line-to waveguide adapter.

In the foregoing making method, the electromagnetic parameter adjusting component is made of a left-handed material.

Based on an embodiment in which the electromagnetic parameter adjusting component is made of the left-handed material, as an embodiment of the making method of the present invention, the disposing an electromagnetic parameter adjusting component inside a cavity of the cavity-shaped waveguide connection component includes: filling, along an axial direction of the cavity-shaped waveguide connection component, one side of a waveguide short-circuit end of the cavity-shaped waveguide connection component with the electromagnetic parameter adjusting component made of the left-handed material, and enabling at least one side surface of the electromagnetic parameter adjusting component not to be seamlessly spliced with one inner wall of the cavity-shaped waveguide connection component.

In order to easier provide analytical analysis on an entire coaxial line-to waveguide adapter and an empirical table formed by an analysis result, to facilitate table searching performed when a coaxial line-to waveguide adapter of a same type is designed sequentially, and to avoid boundary discontinuity introduced in multiple directions, reduce amplitude and a mode quantity of higher order modes, and reduce an insertion loss of the coaxial line-to waveguide adapter, based on the embodiment in which the electromagnetic parameter adjusting component is made of the left-handed material, as another embodiment of the making method of the present invention, the disposing an electromagnetic parameter adjusting component inside a cavity of the cavity-shaped waveguide connection component includes: filling, along an axial direction of the cavity-shaped waveguide connection component, one side of a waveguide short-circuit end of the cavity-shaped waveguide connection component with the electromagnetic parameter adjusting component made of the left-handed material, and enabling each side surface of the electromagnetic parameter adjusting component to be seamlessly spliced with each inner wall of the cavity-shaped waveguide connection component.

In the foregoing embodiments of the method for making a coaxial line-to waveguide adapter, along the axial direction of the cavity-shaped waveguide connection component, a dimension of the electromagnetic parameter adjusting component is not greater than a distance, along the cavity-shaped waveguide connection component, between the coaxial internal conductor and the short-circuit end of the cavity-shaped waveguide connection component.

The foregoing descriptions are merely exemplary implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A coaxial line-to-waveguide adapter, comprising:

a cavity-shaped waveguide connection component;

a coaxial external conductor connected to the cavity-shaped waveguide connection component;

a coaxial internal conductor disposed inside the coaxial external conductor along an axial direction of the coaxial external conductor and inserted into the cavity-shaped waveguide connection component; and an electromagnetic parameter adjusting component disposed inside a cavity of the cavity-shaped waveguide connection component for reducing an effective dielectric constant and an effective magnetic conductivity of the coaxial line-to-waveguide adapter, wherein the electromagnetic parameter adjusting component comprises a left-handed material.

2. The coaxial line-to-waveguide adapter according to claim 1, wherein the cavity-shaped waveguide connection component comprises a waveguide short-circuit end, wherein a depth at which the coaxial internal conductor is inserted into the cavity-shaped waveguide connection component is d, a distance between the coaxial internal conductor and the waveguide short-circuit end of the cavity-shaped waveguide connection component is l, a dimension of the electromagnetic parameter adjusting component along the axial direction of the cavity-shaped waveguide connection component is h, and adjustment of a value of d, l, and/or h is used for limiting a range of an effective wave number of the coaxial line-to-waveguide adapter.

3. The coaxial line-to-waveguide adapter according to claim 1, wherein the cavity-shaped waveguide connection component comprises a waveguide short-circuit end, wherein one side of the waveguide short-circuit end of the cavity-shaped waveguide connection component is filled, along an axial direction of the cavity-shaped waveguide connection component, with the electromagnetic parameter adjusting component made of the left-handed material, wherein the electromagnetic parameter adjusting component comprises one or more side surfaces, and a respective side surface of the electromagnetic parameter adjusting component is seamlessly spliced with a corresponding inner wall of the cavity-shaped waveguide connection component.

4. The coaxial line-to-waveguide adapter according to claim 1, wherein the cavity-shaped waveguide connection component comprises a waveguide short-circuit end, wherein one side of the waveguide short-circuit end of the cavity-shaped waveguide connection component is filled, along an axial direction of the cavity-shaped waveguide connection component, with the electromagnetic parameter adjusting component made of the left-handed material, wherein the electromagnetic parameter adjusting component comprises one or more side surfaces, and at least one side surface of the electromagnetic parameter adjusting component is not seamlessly spliced with a corresponding inner wall of the cavity-shaped waveguide connection component.

5. The coaxial line-to-waveguide adapter according to claim 1, wherein the cavity-shaped waveguide connection component comprises a waveguide short-circuit end, wherein, a dimension of the electromagnetic parameter adjusting component along the axial direction of the cavity-shaped waveguide connection component is not greater than a distance between the coaxial internal conductor and the waveguide short-circuit end of the cavity-shaped waveguide connection component.

6. A method for making a coaxial line-to-waveguide adapter, the method comprising:

providing a cavity-shaped waveguide connection component that can fit a waveguide that needs to be connected;

connecting a coaxial external conductor to the cavity-shaped waveguide connection component;

disposing a coaxial internal conductor inside the coaxial external conductor along an axial direction of the coaxial external conductor;

inserting the coaxial internal conductor into the cavity-shaped waveguide connection component; and disposing an electromagnetic parameter adjusting component inside a cavity of the cavity-shaped waveguide connection component for reducing an effective dielectric constant and an effective magnetic conductivity of the coaxial line-to-waveguide adapter, wherein the electromagnetic parameter adjusting component comprises a left-handed material.

7. The method according to claim 6, wherein the cavity-shaped waveguide connection component comprises a waveguide short-circuit end, wherein a dimension of the electromagnetic parameter adjusting component along the axial direction of the cavity-shaped waveguide connection component is not greater than a distance, along the cavity-shaped waveguide connection component, between the coaxial internal conductor and the waveguide short-circuit end of the cavity-shaped waveguide connection component.

8. The method according to claim 6, wherein the cavity-shaped waveguide connection component comprises a waveguide short-circuit end, wherein the method further comprises:

limiting a range of an effective wave number of the coaxial line-to-waveguide adapter by adjusting a value of d, l, and/or h, wherein d is a depth at which the coaxial internal conductor is inserted into the cavity-shaped waveguide connection component, l is a distance between the coaxial internal conductor and the waveguide short-circuit end of the cavity-shaped waveguide connection component, and h is a dimension of the electromagnetic parameter adjusting component along the axial direction of the cavity-shaped waveguide connection component.

9. The method according to claim 6, wherein the cavity-shaped waveguide connection component comprises a waveguide short-circuit end, wherein the electromagnetic parameter adjusting component comprises one or more side surfaces, wherein disposing the electromagnetic parameter adjusting component inside a cavity of the cavity-shaped waveguide connection component comprises:

filling, along an axial direction of the cavity-shaped waveguide connection component, one side of the waveguide short-circuit end of the cavity-shaped waveguide connection component with the electromagnetic parameter adjusting component made of the left-handed material, and enabling a respective side surface of the electromagnetic parameter adjusting component to be seamlessly spliced with a corresponding inner wall of the cavity-shaped waveguide connection component.

10. The method according to claim 6, wherein the cavity-shaped waveguide connection component comprises a waveguide short-circuit end, wherein the electromagnetic parameter adjusting component comprises one or more side surfaces, wherein disposing an electromagnetic parameter adjusting component inside a cavity of the cavity-shaped waveguide connection component comprises:

filling, along an axial direction of the cavity-shaped waveguide connection component, one side of a waveguide short-circuit end of the cavity-shaped waveguide connection component with the electromagnetic parameter adjusting component made of the left-handed material, and enabling at least one side surface of the electromagnetic parameter adjusting component not to be seamlessly spliced with a corresponding inner wall of the cavity-shaped waveguide connection component.

* * * * *